US005951789A

United States Patent [19]

Ueta et al.

[11] Patent Number: 5,951,789

[45] Date of Patent: Sep. 14, 1999

[54] HEAT RESISTING ALLOY FOR EXHAUST VALVE AND METHOD FOR PRODUCING THE EXHAUST VALVE

[75] Inventors: Shigeki Ueta, Tokai; Toshiharu Noda, Tajimi; Michio Okabe, Chita, all of Japan

[73] Assignee: Daido Tokushuko Kabushiki Kaisha, Aichi-prefecture, Japan

[21] Appl. No.: 08/955,753

[22] Filed: Oct. 22, 1997

[30] Foreign Application Priority Data

| | | | |
|---|---|---|---|
| Oct. 25, 1996 | [JP] | Japan | 8-301223 |
| Oct. 25, 1996 | [JP] | Japan | 8-301224 |
| Jul. 2, 1997 | [JP] | Japan | 9-025616 |

[51] Int. Cl.[6] ..... C22C 30/00; C21D 8/00

[52] U.S. Cl. ..... 148/325; 148/442; 420/49; 420/582; 420/584; 420/585; 420/586

[58] Field of Search ..... 420/49, 582, 584, 420/585, 586; 148/325, 442

[56] References Cited

U.S. PATENT DOCUMENTS 4,767,597 8/1988 Nishimo et al. ..... 420/443

FOREIGN PATENT DOCUMENTS

| | | |
|---|---|---|
| 1118381 | 3/1996 | China . |
| 49-117320 | 11/1974 | Japan . |
| 50-137327 | 10/1975 | Japan . |
| 4191344 | 7/1992 | Japan . |
| 7-238349 | 9/1995 | Japan . |

*Primary Examiner*—Sikyin Ip

*Attorney, Agent, or Firm*—Sughrue, Mion, Zinn, Macpeak & Seas, PLLC

[57] ABSTRACT

A heat resisting alloy for use in exhaust valves low in price and excellent in the cold workability and possible to be formed into valve shapes through the cold or warm working, which consists by weight percentage of C: 0.01~0.1%, Si≦2%, Mn≦2%, Cr: 12~25%, Nb+Ta: 0.2~2.0%, Ti≦3.5%, Al: 0.5~3.0%, Ni: 25~45%, Cu: 0.1~5.0%, optionally at least one element selected from W≦3%, Mo≦3%, and V≦1% with (½W+Mo+V)≦3%, Co≦5% with Ni+Co: 25~45%, Ca+Mg: 0.001~0.01%, one or both of B≦0.01% and Zr: 0.001~0.1%, and the balance of Fe and incidental impurities.

9 Claims, 2 Drawing Sheets

HEAT RESISTING ALLOY FOR EXHAUST VALVE AND METHOD FOR PRODUCING THE EXHAUST VALVE

BACKGROUND OF THE INVENTION

1. Field of the Invention

This invention relates to a heat resisting alloy especially excellent in cold workability and suitable to be used for exhaust valves of automotive engines, and a method for producing the exhaust valves using the above-mentioned heat resisting alloy.

2. Description of the Prior Art

Heretofore, as a material for an exhaust valve of automotive engines or so, high Mn austenitic heat resisting steel JIS SUH 35 (Fe—9Mn—21Cr—4Ni—0.5C—0.4N) or Ni-based super alloy JIS NCF 751 (Ni—15.5—Cr—0.9Nb—1.2Al—2.3Ti—7Fe—0.05C) has been used, for example.

Although the aforementioned Ni-based super alloy is an alloy excellent in high-temperature strength, high-temperature oxidation resistance and high-temperature corrosion resistance, there is a problem in the cost since the alloy contains expensive Ni as much as a little more than 70 wt %.

Accordingly, an approach for decreasing the amount of expensive Ni has been carried out, and alloys containing Ni of 40 wt % or less have been already developed.

However, further decrease of Ni content causes problems in properties of the alloy and it is difficult realistically to further reduce the Ni content in the alloy.

Namely, if the Ni content is further decreased, stability of the structure at a high-temperature is detriorated owing to increase of Fe, η-phase ($Ni_3Ti$) which is a brittle phase is precipitated during the long time application at a high-temperature, thereby bringing deterioration in the high-temperature strength and the toughness at a room temperature of the alloy. Thus, there is a limit naturally in the decrease of the Ni content for a reason of the problem in the properties of the alloy.

On the other side, an exhaust valve of automotive engines has been produced conventionally through a process of the following steps.

First of all, the heat resisting alloy of Fe—Cr—Ni type is cold-drawn to form a bar with predetermined dimensions. Next, a head portion of the valve is formed through hot upsetting after preforming the bar through electric upsetting, for example. Subsequently, the head portion is usually joined in one body with a stem portion made of a martensitic heat resisting steel specified as JIS SUH-11 (Fe—1.5Si—8.5Cr—0.5C) or SUH-3 (Fe—2Si—11Cr—1Mo—0.4C) through friction welding, for example.

After this, solid solution treatment is performed in order to release a strain stored through the aforementioned workings, and high-temperature strength as the exhaust valve is obtained by precipitating τ-phase such as $(Ni,Cr)_3(Al,Ti,Nb,Ta)$ through aging treatment.

Furthermore, a tail end of the stem of the valve is hardened by quenching according to demand, and the exhaust valve is forwarded finally after finishing by machining.

However, there is a problem in the aforementioned conventional method in that it is necessary to form the head portion through two steps consisting of the preforming by the electric upsetting after the preforming. The head portion formed through the hot upsetting is not so excellent in the dimensional accuracy and it is required to completely remove defects on a surface of the formed head portion, therefore there are the other problems in that cutting amount in the finishing process is apt to increase and times required for the finishing is also apt to become longer. Furthermore, solid solution treatment is necessary before the aging treatment.

All of these problems are causes for increase of the production cost and are required to be solved.

The former problem in these problems is able to be solved fundamentally by forming the head portion of the valve through a step of cold working or warm working instead of the hot working such as the hot upsetting. In this case, the heat resisting alloy as a raw material of the head portion is required to be excellent in the cold workability.

However, the heat resisting alloys proposed and used practically up to the present have been developed assuming the hot working in all cases, therefore it has been difficult to form the head portion by carring out the cold or warm forging to the raw material of these alloys.

SUMMARY OF THE INVENTION

This invention is made in order to solve the aforementiond problems in the prior art, it is an object to provide a heat resisting alloy which is inexpensive in consequence of the Ni content on a relatively low level, excellent in the cold workability and possible to be formed into the exhaust valve at a low price through the cold working, and it is another object to provide a method for producing the exhaust valve having excellent properties equivalent to that of the conventional exhaust valve by using the aforementioned heat resisting alloy without increasing the production cost.

The heat resisting alloy for exhaust valves according to this invention for accomplishing the aforementioned object is characterized by consisting by weight percentage of 0.01 to 0.1% of C, not more than 2% of Si, not more than 2% of Mn, 12 to 25% of Cr, 0.2 to 2.0% in total of Nb and Ta, not more than 3.5% of Ti, 0.5 to 3.0% of Al, 25 to 45% of Ni, 0.1 to 5.0% of Cu, and the balance being Fe plus incidental impurities. The heat resisting alloy according to this invention may further contain at least one element selected from not more than 3% of W, not more than 3% of Mo and not more than 1% of V with the proviso that (½W+Mo+V) is at most equal to 3%, not more than 5% of Co with the proviso that total percentage of Ni and Co is in a range of 25 to 45%, 0.001 to 0.01% of Ca and Mg in total, and one or both of 0.001 to 0.01% of B and 0.001 to 0.1% of Zr, according to demand.

In preferred embodiments of the heat resisting alloy according to this invention, total atomic percentage of Ti, Al, Nb and Ta is desirable to be in a range of 4.5 to 7.0%, Ti/Al (atomic percentage ratio) is also desirable to be in a range of not higher than 2.0, and M-valve calculated from the following equation is desirable to not exceed 0.95 ; M={0.717 Ni(atomic percentage)+0.858Fe(atomic percentage)+1.142Cr(atomic percentage)+1.90Al(atomic percentage)+2.271Ti(atomic percentage)+2.117Nb(atomic percentage)+2.224Ta(atomic percentage)+1.001Mn(atomic percentage)+0.615Cu(atomic percentage)}/100. Furthermore, it is advisable to control the impurities such as P.S.O. and N so that P may be not higher than 0.02%, S.O. and N may be not higher than 0.01%, respectively.

The method for producing the exhaust valve according to another aspect of this invention is characterized by comprising the steps of subjecting a raw material of the heat resisting alloy according to this invention to solid solution treatment, forming a head portion of the exhaust valve from the solution treated raw material through cold working or warm working, joining a stem portion made of martensitic heat resisting steel to said head portion of the exhaust valve, and subjecting the head portion and stem portion joined with each other to aging treatment.

In preferred embodiments of the method for producing the exhaust valve according to this invention, it is desirable to further subject the stem portion of the exhaust valve to nitriding after the aging treatment, and it is advisable to further subject the stem portion of the exhaust valve to quench hardening after the nitriding at a tail end thereof.

DETAILED DESCRIPTION OF THE INVENTION

Figure 1:
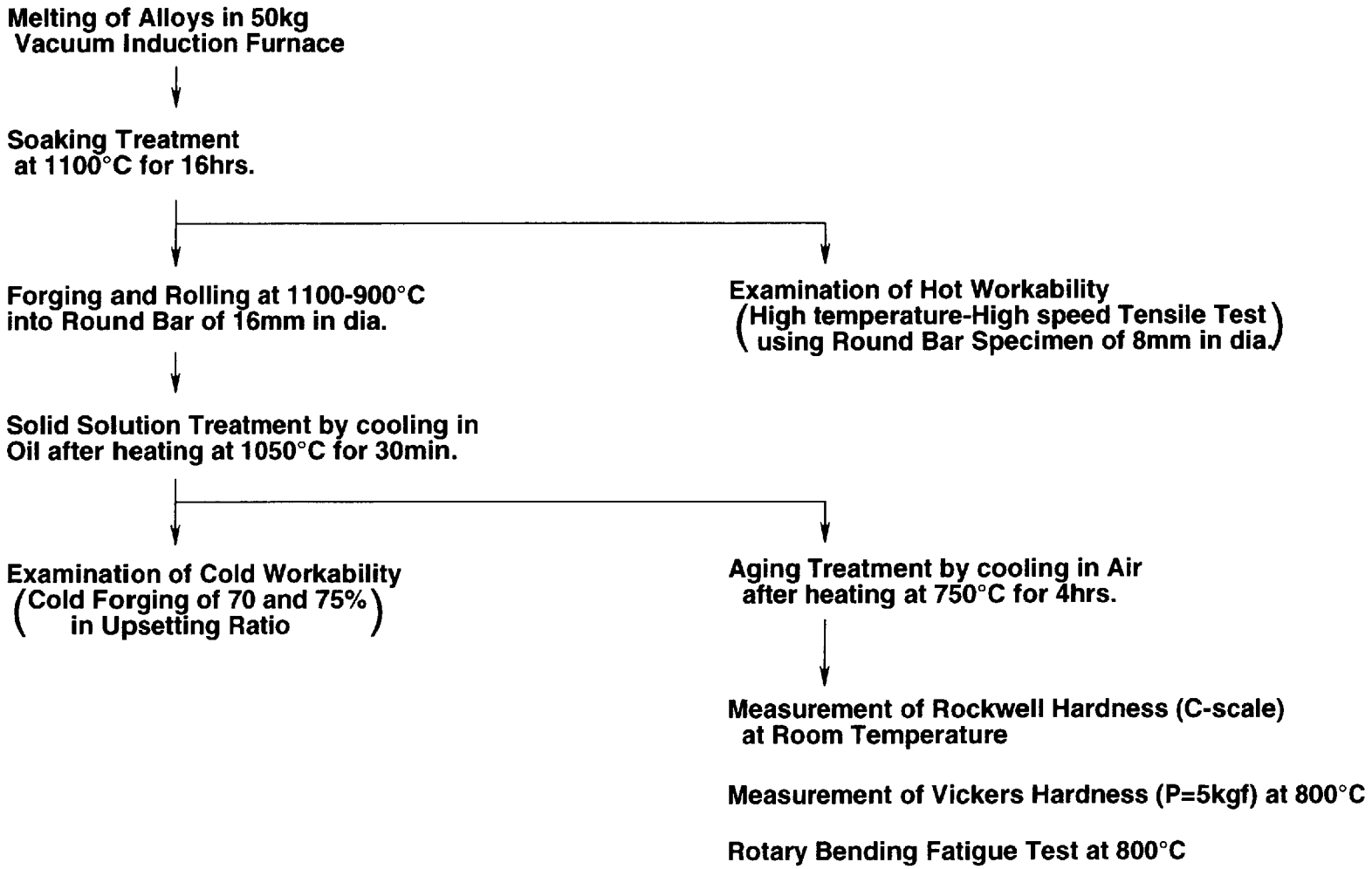
FIG. 1 is a flow diagram showing a process of heat treatment of alloys in Example 1 together with testing methods of the alloy.

The heat resisting alloy for exhaust valves according to this invention is low in the cost owing to the Ni content on a low level and excellent in the cold workability, so that it is possible to be applied for producing the exhaust vale through the cold working and possible to reduce the production cost of the exhaust valve. Namely, it is possible to reduce the material cost of the heat resisting alloy and the production cost of the exhaust valve by applying the heat resisting alloy to the exhaust valve at the same time.

The heat resisting alloy according to this invention has a special feature in that Cu is contained in a predetermined range, and Cu works so as to inhibit the work hardening by increasing stacking fault energy, thereby improving the cold workability of the heat resisting alloy effectively.

In the heat resisting alloy according to this invention, one or more of W, Mo and V may be further contained in addition to C, Si, Mu, Cr, Nb+Ta, Ti, Al, Ni and Cu in the range of not more than 3% of W, not more than 3% of Mo, not more than 1 % of V with the proviso that (½W+Mo+V) is not more than 3%.

W, Mo and V are dissolution strengthen elements, and it is possible to improve the strength of the heat resisting alloy effectively.

Furthermore, Co may be contained in the range of not more than 5% of Co and 25 to 45% in total of Ni and Co. Co has an effect similar to that of Ni, therefore may be contained by replacing a part of Ni in the range up to 5%.

In the heat resisting alloy according to this invention. Total atomic percentage of Ti, Al, Nb and Ta may be limited in the range of 4.5 to 7.0%, and the atomic percentage ratio of Ti and Al (Ti/Al) may be limited to not higher than 2.0.

Furthermore, M-Value, which is an index indicating the stability of τ-phase, may be limited so as to not exceed 0.95, and one or both of B and Zr may be contained in the range of 0.001 to 0.01% of Zr and 0.001 to 0.1% of Zr. It is possible to strength grain boundaries of the alloy by adding one or both of B and Zr.

In the heat resisting alloy according to this invention, Ca and Mg may be further contained in the range of 0.001 to 0.01% in total of Ca and Mg, thereby improving hot workability of the alloy.

Furthermore, P.S.O. and N may be controlled in the range of noto more than 0.02% of P, not more than 0.01% of S, not more than 0.01% of O and not more than 0.01% of N. These elements are impurities, and it is possible to further improve the properties of the heat resisting alloy by controlling these inpure elements in the above-mentioned range.

The heat resisting alloy according to this invention exhibits the substantial properties by subjecting to solid solution treatment depending on circumstances after the cole working, and subsequently subjecting to the aging treatment. In a case of applying the heat resisting alloy to the production of heat resisting members such as exhaust valves, it is possible to give required quality and possible to produce the heat resisting members in low price.

The reason why the respective chemical composition of the heat resisting alloy according to this invention is limited will be described below.

C: 0.01 to 0.1 wt %

It is possible to improve the high-temperature strength of the alloy by containing C not less than 0.01% and forming carbides together with T, Nb or Cr. However, when C is contained more than 0.1%, MC-type carbides are precipitated in a large quantity, so that the hot workability of the alloy is deteriorated and defects or flaws develop from the carbides at the time of working. Accordingly, the C content is defined in the range of 0.01 to 0.1% in this invention.

Si: not more than 2 wt %

Si is useful as a deoxidation element and improves the oxidation resistance of the alloy. However, when Si is contained more than 2%, the cold workability of the alloy is degraded, so that the upper limit of Si is defined as 2%.

Mn: not more than 2 wt %

Although Mn is a useful as a deoxidation element similarly to Si, the high-temperature oxidation resistance is harmed and precipitation of η-phase ($Ni_3Ti$) which is harmful to the toughness of the alloy is promoted when Mn is contained in large quantities. Therefore, the upper limit of Mn is defined as 2%.

Cr: 12 to 25 wt %

Cr is a valuable element for improving the high-temperature oxidation resistance and the corrosion resistance and it is necessary to contain Cr in an amount of not less than 12% in order to obtain such the effects. However, the austenite phase becomes unstable and σ-phase (brittle phase) is precipitated, thereby degrading the toughness of the alloy when Cr is contained in an amount of more than 25%. Therefore, the upper limit of Cr is defined as 25%. A preferable range of Cr is 12 to 20%.

Nb+Ta: 0.2 to 2.0 wt %

Nb and Ta are elements for forming an intermetallic compound τ'-phase (τ-prime phase) $Ni_3(Al,Ti,Nb,Ta)$ together with Ni, which is an important precipitation hardening phase, and it is possible to effectively improve the high-temperature strength of the alloy by the precipitation of the τ'-phase. It is necessary to contain one or both of Nb and Ta of not less than 0.2% in total in order to obtain such the effects. However the toughness of the alloy is degraded owing to precipitation of δ-phase $Ni_3(Nb,Ta)$ when Nb and Ta exceed 2.0% in total, accordingly the upper limit of the total amount of Nb and Ta is defined as 2.0%. The total percentage of Nb and Ta is preferable to be limit in a range of 0.5 to 1.5%.

Ti: not more than 3.5 wt %

Ti combines with Ni to form the τ'-phase together with Al, Nb, Ta. Further, aging precipitation of the τ'-phase is activated by addition of Ti. On the other side, the η-phase (brittle phase) is precipitated and the toughness of the alloy is deteriorated when Ti is contained in an amount of more than 3.5%, therefore the upper limit of Ti is defined as 3.5%.

Additionally, it is preferable to add not lower than 1.5% of Ti in a case of activating the aging precipitation at the aging treatment after the solid solution treatment subsequent to the cold working, however it is desirable to limit Ti in a range of lower than 1.5% so as not to activate the aging precipitation in a case of directly performing the aging treatment after the cold working without solid solution treatment.

Al: 0.5 to 3.0 wt %

Al is the most important element to form the τ'-phase by being combined with Ni, and the τ'-phase is not precipitated sufficiently if the Al content is less than 0.5%, so that the lower limit of Al is defined as 0.5%.

On the other side, the hot workability of the alloy is deteriorated when the Al content becomes higher than 3.0%. Therefore, the upper limit of Al is defined as 3.0% in this invention. Al is preferable to be limited in a range of 0.7 to 2.0%.

Ni: 25 to 45 wt %

Ni is an element to form austenite, that is a matrix of the alloy, and improves the heat resistance and the corrosion resistance of the alloy. Furthermore, it is the indispensable element for precipitating the τ'-phase being a reinforcement phase.

In addition to above, Ni has function to stabilize structure of the alloy at a high temperature, and it is necessary to contain Ni of 25% or more in order to obtain the aforementioned effects sufficiently. However, when Ni is contained in an amount of more than 45%, cost of the alloy becomes higher and it becomes impossible to attain the purpose of this invention since Ni is an expensive element. Furthermore, in the heat resisting alloy according to this invention, Ni increases the hardness in the solid solution treated state and the cold workability of the alloy is deteriorated. Accordingly, the upper limit of the Ni content is defined as 45% in this invention. It is preferable to limit the Ni content in a range of 27 to 35%.

Cu: 0.1 to 5.0 wt %

Cu is an element indispensable for improving the cold workability of the alloy in this invention.

As mentioned above, Cu has function to inhabit the work hardening by increasing stacking fault energy, so that the cold workability of the alloy is improved efficiently in consequence of this function.

However, it is not possible to expect sufficient effect when the Cu content is lower than 0.1% and the effect is not improved so much even if Cu is contained in an amount of more than 5.0% and the hot workability of the alloy is rather deteriorated. Accordingly, the Cu content is defined in the range of 0.1 to 5.0% in this invention. It is preferable to limit the Cu content in a range of 0.1 to 5.0%.

W: not more than 3 wt %

Mo: not more than 3 wt %

V: not more than 1 wt %

½W+Mo+V: not more than 3 wt %

W, Mo and V are elements effective for improving the high-temperature strength of the alloy owing to the dissolution strengthening. However, the effect of these elements has a tendency to be suturated, the cost is increased and the cold workability of the alloy is degraded even if these elements are added in excess. Therefore, these elements may be contained according to demand in the range of not more than 3% of W, not more than 3% of Mo, not more than 1% of V with the proviso that (½W+Mo+V) is not more than 3%.

Ni+Co: 25 to 45 wt %

Co: not more than 5 wt %

Co has function similar to that of Ni, and may be contained in the alloy so as to replace a part of Ni with Co. Namely, Co may be contained in the alloy in the range of 20 to 45% in total of Ni and Co. However, the upper limit of Co is desirable to defined as 5% because Co is an expensive element as compared with Ni.

Ti+Al+Nb+Ta: 4.5 to 7.0 at %

Ti, Al, Nb and Ta are structural elements of the τ'-phase without exception. In the presence of sufficient Ni, the amount of the precipitated τ'-phase is proportional to the sum total of amounts of these elements, and the high-temperature strength of the alloy is in proportion to the amount of the τ'-phase precipitated. It is desirable to contain these elements of not less than 4.5% in total atomic percentage in order to sufficiently improve the high-temperature strength of the alloy in this invention.

However, when the total atomic percentage of these elements exceeds 7.0%, the strength of the alloy is increased, but the cold workability is inclined to be degraded. Therefore, the upper limit of the total atomic percentage of these elements is advisable to be defined as 7.0%.

Ti/Al(atomic percentage): not higher than 2.0

Intermetallic compound η-phase($Ni_3Ti$), which is precipitated during the application at a high temperature for a long time, deteriorates mechanical properties of the alloy. The precipitation of η-phase depends on the ratio of atomic percentage of Ti and Al (Ti/Al). Namely, η-phase becomes easy to be precipitated with the increase of the atomic ratio of Ti/Al. Therefore, it is desirable to limit the atomic ratio of Ti/Al in a range of not higher than 2.0 so as not to precipitate the η-phase even after the long time application in this invention.

In a case of performing the solid solution treatment in advance of the aging treatment after the cold working, it is further desirable to define the atomic ratio of Ti/Al in a range of 1.0 to 2.0 so as not to decrease the hardening speed and not to harden the alloy insufficiently at the aging treatment.

However, the atomic ratio of Ti/Al is desirable to be limited in a range of lower than 1.0(preferable lower limit of Ti/Al ratio is 0.2) so as not to proceed the hardening excessively at the aging treatment when the aging treatment is performed directly after the cold working without performing the solid solution treatment.

M-value: not exceeding 0.95

M={0.717Ni(atomic percentage)+0.858Fe(atomic percentage)+1.142Cr(atomic percentage)+1.90Al(atomic percentage)+2.271Ti(atomic percentage)+2.117Nb(atomic percentage)+2.224Ta(atomic percentage)+1.001Mn(atomic percentage)+1.90Si(atomic percentage)+0.616Cu(atomic percentage)}/100

M-value is an index indicating the stability of the τ-phase, and τ-phase(intermetallic compound) is precipitated when the M-value becomes larger than 0.95. The σ-phase has a tendency to deteriorate the mechanical property of the alloy. Furthermore, when the M-value becomes larger than 0.95, the hot workability is apt to be deteriorated. Therefore, it is preferable to control the M-value so as not to exceed 0.95.

B: 0.001 to 0.01 wt %

Zr: 0.001 to 0.1 wt %

B and Zr are precipitated at grain boundary and have a tendency to strengthen the grain boundary of the alloy. The effect of this kind reveals itself sufficiently when these elements are contained in the range of not less than 0.001%, respectively. However, the hot workability of the alloy is harmed when B is contained more than 0.01% or Zr is contained more than 0.1%, accordingly the upper limits of B and Zr are defined as 0.01% and 0.1%, respectively.

Ca+Mg: 0.001 to 0.01 wt %

These elements are elements to be added as deoxidizer and desulfurizer at the time of melting the alloy, and have a tendency to improve the hot workability of the alloy. Such the effect reveals itself when these elements are contained not less than 0.001% in total. However, the hot workability is deteriorated when these elements are contained more than 0.01% in total. Therefore, the upper limit of total percentage of Ca and Mg is advisable to be defined as 0.01%.

P: not more than 0.02 wt %

S: not more than 0.01 wt %

O: not more than 0.01 wt %

N: not more than 0.01 wt %

All of these elements are brought into the alloy as incidental impurities. Among them, P and S deteriorate the hot workability of the alloy, and O and N form oxides and nitrides(non-metallic inclusion) to deteriorate the mechanical property of the alloy. Therefore, it is desirable to define the upper limits of P, O, S and N as 0.02%, 0.01%, 0.01% and 0.01%, respectively.

In the method for producing an exhaust valve according to another aspect of this invention, the head portion of the exhaust valve is formed at first using the aforementioned heat resisting alloy as a raw material through the following process.

First of all, the raw material of the heat resisting alloy is formed into a bar having a predetermined shape through hot forging and hot rolling after subjecting the raw material to soaking treatment.

Next, the bar is subjected to solid solution treatment. Namely, the bar is quenched into water or oil after holding the bar at a temperature of 1000 to 1100° C. for 10 to 60 minutes or so.

In consequence of the solid solution treatment, Cr-carbides, the τ'-phase and the η-phase(brittle phase) are dissolved in the alloy, softening of the alloy proceeds by recrystallization, internal stress stored by the cogging and rolling is released and the bar is softened generally.

The formation of the head portion of the exhaust valve is started from the solid solution treated bar. Namely, the head portion having an objective shape is formed by subjecting the solid solution treated bar to cold wording or warm wording directly. It is possible to perform the cold or worm working, for example cold upsetting very smoothly since the bar is already softened through the solid solution treatment. Furthermore, the head portion is formed accurately in dimensions through the cold or warm working and cutting amount in the finishing process becomes smaller, and the cast required for forming the head portion is saved as compared with a case of hot working.

Subsequently, a stem portion made of a low temperature annealed martensitic heat resisting steel such as JIS SUH-11 and SUH-3, for example is joined to the above-mentioned head portion through, for example, friction welding, whereby the exhaust valve having an objective shape is obtained.

In the method according this invention, the obtained exhaust valve is subjected to aging treatment without solid solution treatment after the joining at a temperature of 650 to 800° C. for 0.5 hour, for example.

In consequence of the aging treatment, the head portion of the exhaust valve is hardened up to Hv 350~500 because the precipitaion of the τ'-phase proceeds in addition to the work hardening owing to residual strain at the time of the cold working. At the joined portion of the exhaust valve, the hardness is lowered down to Hv 250~350 owing to tempering of martensite and the toughness of the joined portion is improved.

Finally, the directing exhaust valve is produced through the finishing process.

In this invention, it is favorable to form a nitrided layer on the stem portion of the exhaust valve through nitriding in succession to the finishing because the exhaust valve is improved in the wearing resistance.

Although the method for nitriding is not restricted especially, it is preferable to apply a liquid nitriding method represented by the tufftride from a view point that the very thin nitrided layer excellent in the toughness and the wearing resistance can be formed.

Furthermore, in a case where the exhaust valve is a rocker arm type, it is effective to perform quench hardening at the tail end of the stem portion in order to prevent wearing at the tail end of the stem portion. As a method for the quench hardening, it is possible to apply induction hardening or flame hardening, for example.

EXAMPLE

Next, suitable examples of this invention will be explained below together with comparative examples.

Example 1

Alloys of 50 kg having chemical compositions as shown in Table 1 were melted respectively in a vacuum induction furnace, thereby obtaining ingots, and properties of the respective alloys were examined according to the process shown in FIG. 1.

First of all, a round bar specimen of 8 mm in diameter was cut out from a bottom portion of each of ingots after subjecting the ingots to soaking treatment at a temperature of 1100° C. for 16 hours, and hot workability of the respective alloys were examined by high temperature-high speed tensile test using the specimens.

TABLE 1

| Alloy No. | | Chemical composition (wt %) C | Si | Mn | P | S | Cu | Ni | Co | Cr | Mo | W | V | Nb + Ta | Al | Ti | B | Zr | Ca + Mg | O | N | Fe | M-value | Ti/Al (at %) | Al + Ti + Nb + Ta (at %) |
|---|---|---|---|---|---|---|---|---|---|---|---|---|---|---|---|---|---|---|---|---|---|---|---|---|---|
| Invention alloy | 1 | 0.032 | 0.21 | 0.21 | — | — | 0.97 | 32.3 | — | 16.0 | — | — | — | 0.25 | 2.15 | 1.56 | — | — | — | — | — | Bal. | 0.937 | 0.41 | 6.28 |
| | 2 | 0.051 | 0.18 | 0.16 | — | — | 2.06 | 32.0 | — | 15.9 | — | — | — | 0.28 | 1.85 | 1.76 | — | — | — | — | — | Bal. | 0.931 | 0.54 | 5.94 |
| | 3 | 0.020 | 0.04 | 0.06 | — | — | 3.98 | 27.1 | — | 12.8 | — | — | — | 0.24 | 0.67 | 3.23 | — | — | — | — | — | Bal. | 0.922 | 2.72 | 5.27 |
| | 4 | 0.074 | 0.05 | 0.08 | — | — | 4.07 | 42.2 | — | 21.0 | — | — | — | 0.81 | 0.86 | 2.79 | — | — | — | — | — | Bal. | 0.929 | 1.83 | 5.50 |
| | 5 | 0.011 | 1.20 | 1.20 | — | — | 3.96 | 42.1 | — | 19.1 | — | — | — | 0.81 | 1.15 | 2.67 | 0.0039 | — | — | — | — | Bal. | 0.952 | 1.31 | 5.89 |
| | 6 | 0.033 | 0.23 | 0.20 | — | — | 3.09 | 32.1 | — | 15.8 | — | — | — | 0.82 | 0.99 | 2.40 | — | — | — | — | — | Bal. | 0.927 | 1.37 | 5.30 |
| | 7 | 0.032 | 0.21 | 0.21 | — | — | 2.05 | 32.3 | — | 16.0 | — | — | — | 0.83 | 1.43 | 2.53 | — | — | — | — | — | Bal. | 0.940 | 1.00 | 6.33 |
| | 8 | 0.051 | 0.24 | 0.21 | — | — | 1.98 | 32.0 | — | 16.1 | 0.55 | — | 0.51 | 0.81 | 1.22 | 2.65 | — | — | — | — | — | Bal. | 0.944 | 1.22 | 6.04 |
| | 9 | 0.052 | 0.12 | 0.11 | — | — | 3.28 | 37.1 | — | 18.0 | — | 1.02 | — | 0.51 | 1.17 | 2.19 | — | — | — | — | — | Bal. | 0.924 | 1.05 | 5.27 |
| | 10 | 0.030 | 0.22 | 0.20 | — | — | 1.03 | 32.2 | — | 17.8 | 1.66 | 0.01 | — | 0.30 | 1.10 | 2.15 | — | — | — | — | — | Bal. | 0.938 | 1.10 | 4.93 |
| | 11 | 0.061 | 0.25 | 0.23 | — | — | 3.44 | 31.1 | 0.5 | 15.8 | — | — | — | 0.59 | 1.34 | 2.03 | — | — | — | — | — | Bal. | 0.926 | 0.85 | 5.43 |
| | 12 | 0.055 | 0.24 | 0.23 | — | — | 3.13 | 29.6 | 2.2 | 16.1 | — | — | — | 0.78 | 1.13 | 2.36 | — | — | — | — | — | Bal. | 0.931 | 1.18 | 5.50 |
| | 13 | 0.033 | 0.22 | 0.21 | — | — | 2.10 | 32.0 | — | 16.0 | — | — | — | 1.52 | 1.21 | 1.77 | 0.0032 | — | — | — | — | Bal. | 0.929 | 0.84 | 5.45 |
| | 14 | 0.044 | 0.19 | 0.22 | — | — | 2.06 | 31.9 | — | 16.1 | — | — | — | 0.80 | 1.41 | 2.55 | — | 0.0033 | — | — | — | Bal. | 0.940 | 1.02 | 6.29 |
| | 15 | 0.052 | 0.21 | 0.22 | 0.001 | 0.002 | 0.49 | 32.2 | — | 16.0 | — | — | 0.05 | 0.82 | 1.15 | 2.65 | — | — | 0.0023 | — | — | Bal. | 0.938 | 1.30 | 5.89 |
| | 16 | 0.033 | 0.19 | 0.20 | 0.003 | 0.001 | 2.04 | 32.0 | 0.8 | 16.2 | 0.02 | 0.03 | — | 0.79 | 1.18 | 2.67 | 0.0052 | 0.0021 | 0.0030 | 0.0024 | 0.0031 | Bal. | 0.937 | 1.27 | 5.96 |
| | 17 | 0.050 | 0.23 | 0.20 | 0.002 | 0.001 | 1.97 | 32.1 | — | 16.0 | — | — | — | 0.84 | 1.16 | 2.72 | 0.0020 | — | 0.0021 | 0.0014 | 0.0019 | Bal. | 0.937 | 1.32 | 6.01 |
| | 18 | 0.032 | 0.21 | 0.21 | 0.003 | 0.002 | 2.03 | 31.6 | — | 15.9 | — | — | — | 0.83 | 1.38 | 2.56 | 0.0029 | — | 0.0027 | 0.0019 | 0.0023 | Bal. | 0.940 | 1.04 | 6.26 |
| | 19 | 0.031 | 0.20 | 0.20 | 0.003 | 0.002 | 1.05 | 32.2 | — | 16.0 | — | — | — | 0.83 | 1.13 | 2.19 | 0.0028 | — | 0.0018 | 0.0022 | 0.0030 | Bal. | 0.930 | 1.09 | 5.34 |
| Comparative alloy | 1 | 0.052 | 0.19 | 0.19 | 0.008 | 0.006 | — | 24.8 | — | 16.0 | — | — | — | 0.58 | 0.20 | 3.82 | 0.0032 | — | — | 0.0068 | 0.038 | Bal. | 0.946 | 10.76 | 5.16 |
| | 2 | 0.051 | 0.22 | 0.20 | 0.002 | 0.003 | — | 32.1 | — | 16.5 | — | — | — | 0.84 | 1.16 | 2.66 | 0.0058 | — | 0.0054 | 0.0023 | 0.0034 | Bal. | 0.942 | 1.29 | 5.92 |
| | 3 | 0.048 | 0.20 | 0.21 | 0.001 | 0.002 | — | 31.9 | — | 26.2 | — | — | — | 0.79 | 1.28 | 2.66 | 0.0056 | — | 0.0057 | 0.0032 | 0.0029 | Bal. | 0.972 | 1.17 | 6.09 |
| | 4 | 0.049 | 0.33 | 0.26 | 0.002 | 0.002 | 2.0 | 46.9 | — | 18.2 | — | — | — | 1.02 | 0.99 | 2.42 | 0.0050 | — | 0.0043 | 0.0033 | 0.0027 | Bal. | 0.924 | 1.38 | 5.45 |
| | 5 | 0.041 | 0.21 | 0.19 | 0.003 | 0.002 | 2.0 | 59.8 | — | 18.4 | — | — | — | 0.91 | 1.06 | 2.48 | 0.0029 | — | 0.0027 | 0.0020 | 0.0044 | Bal. | 0.907 | 1.32 | 5.63 |
| | 6 | 0.510 | 0.14 | 8.95 | 0.023 | 0.001 | — | 3.8 | — | 20.8 | — | — | — | — | — | — | — | — | — | — | 0.38 | Bal. | 0.906 | — | — |

Each of residual ingots was forged and rolled into around bar of 16 mm in diameter at a temperature of 1100° C.~900° C., and the round bar was subjected to solid solution treatment under a condition of heating at 1050° C. for 30 min. and cooling in oil. Subsequently, the solid solution treated round bars were cold-forged at upsetting ratios of 70% and 75%, respectively and the cold workability was evaluated by examining a state of the crack development by the cold forging. In this time, the cold-forging test was carried out in accordance with standard of Japan Society for Technology of Plasticity as mentioned below.

Each of the solid solution treated round bars was further subjected to aging treatment under the condition of cooling in air after heating at 750° C. for 4 hours, and measurement of Rockwell hardness (C-scale) at a room temperature, measurement of Vickers hardness (5 kgf load) at 800° C., and rotary bending fatigue test at 800° C. were carried out for the aging treated round bar.

Results obtained through these tests are shown in Table 2.

The cold workability of the alloys was evaluated by examining a developed crack ratio at the time of upsetting specimens of 15 mm in diameter and 22.5 mm in length in the axial direction at upsetting ratios of 70% and 75%.

The upsetting ratio $\epsilon$ is expressed by following equation;

$\epsilon=(ho-hc)/ho\times100$ wherein, ho: original height of the specimen hc: height of the specimen after deformation.

the test was repeated by using five specimens.

(Measurement of hardness)

The hardness of the alloys was measured at a room temperature using the Rockwell hardness tester by C-scale.

Furthermore, the high-temperature hardness of the respective alloys was measured at 800° C. using the Vickers high-temperature hardness tester by measuring load of 5 kgf.

(Fatigue test)

Uniform guage test pieces of 8 mm in diameter were cut out from the respective testing materials, and the rotary bending fatigue test was carried out at 800° C. using the

TABLE 2

| Alloy No. | | Upsetting ratio 70% | Upsetting ratio 75% | Hardness after aging room temperature | Hardness after aging 800° C. (HV) | Hot workability Temperature range (τ) | Rotary bending fatigue at 800° C. Number of repetitions (× $10^6$ times) | Remarks |
|---|---|---|---|---|---|---|---|---|
| Invention alloy | 1 | ⊙ | ○ | 27.4 | 224 | 276 | 2.18 | |
| | 2 | ⊙ | ⊙ | 28.9 | 238 | 282 | 2.02 | |
| | 3 | ⊙ | ○ | 32.6 | 245 | 253 | 2.27 | |
| | 4 | ⊙ | ⊙ | 35.1 | 301 | 317 | 2.43 | |
| | 5 | ⊙ | ○ | 33.8 | 288 | 297 | 3.11 | |
| | 6 | ⊙ | ⊙ | 32.5 | 258 | 279 | 3.05 | |
| | 7 | ⊙ | ⊙ | 31.2 | 240 | 276 | 2.81 | |
| | 8 | ⊙ | ⊙ | 32.2 | 260 | 264 | 3.13 | |
| | 9 | ⊙ | ○ | 30.1 | 219 | 296 | 2.09 | |
| | 10 | ⊙ | ○ | 28.7 | 214 | 311 | 1.95 | |
| | 11 | ⊙ | ○ | 31.0 | 256 | 259 | 2.73 | |
| | 12 | ⊙ | ○ | 32.4 | 272 | 255 | 2.86 | |
| | 13 | ⊙ | ○ | 29.7 | 253 | 302 | 2.72 | |
| | 14 | ⊙ | ⊙ | 31.5 | 251 | 298 | 2.79 | |
| | 15 | ⊙ | ○ | 31.3 | 261 | 315 | 3.27 | |
| | 16 | ⊙ | ○ | 31.0 | 252 | 312 | 4.12 | |
| | 17 | ⊙ | ⊙ | 31.9 | 255 | 310 | 4.34 | |
| | 18 | ⊙ | ⊙ | 31.7 | 258 | 322 | 2.81 | |
| | 19 | ⊙ | ⊙ | 30.9 | 234 | 317 | 2.10 | |
| Comparative alloy | 1 | ⊙ | ⊙ | 33.2 | 178 | 218 | 2.04 | lack of high-temperature hardness, precipitation of η-phase |
| | 2 | ○ | X | 31.1 | 264 | 312 | 3.23 | cracked |
| | 3 | X | X | 32.4 | 273 | 234 | 1.51 | cracked, precipitation of γ-phase |
| | 4 | ○ | X | 33.2 | 281 | 330 | 3.70 | cracked |
| | 5 | ○ | X | 33.4 | 280 | 302 | 3.56 | cracked |
| | 6 | X | X | 40.2 | 195 | 252 | 0.26 | cracked, lack of high-temperature hardness |

⊙: Not cracked
○: Crack ratio of lower than 0.5 (50%)
X: Crack ratio of not lower than 0.5 (50%)

The respective tests were performed under the following conditions.

(High temperature-high speed tensile test)

Using the round bar specimen cut out from each of ingots, tensile test as carried out in a speed of 50 mm/s at the respective temperatures between 800 to 1200° C. by high temperature-high speed tensile testing machine. A temperature range possible to obtain reduction of area of not less than 60%, which is required for the roll working was defined as a workable temperature range and the hot workability of the respective alloys were evaluated by obtaining the workable temperature range of each of alloys according to the results of high temperature-high speed tensile test.

(Cold forging test)

Ono-type rotary bending fatigue testing machine. The number of repetitions when stress amplitude was 294 MPa was obtained with the average value of two measurements.

As is apparent from the results shown in Table 2, the heat resisting alloys according to this invention were excellent in both the cold workability and the hot workability and it was confirmed that it is possible to obtain the sufficient hardness not only at a room temperature, but also at a high temperature (800° C.) through the aging treatment.

As compared with the above, the comparative alloy No.1, was excellent in the cold workability, however it was not insufficient in the heat resistance and it was not possible to obtain the sufficient hardness at a high temperature.

In the other comparative alloys, the cold workability was not sufficient in any case.

Furthermore, it was obvious from the results of the fatigue test that the heat resisting alloys according to this invention were equal or excellent also in the fatigue properties.

Example 2

Figure 2:
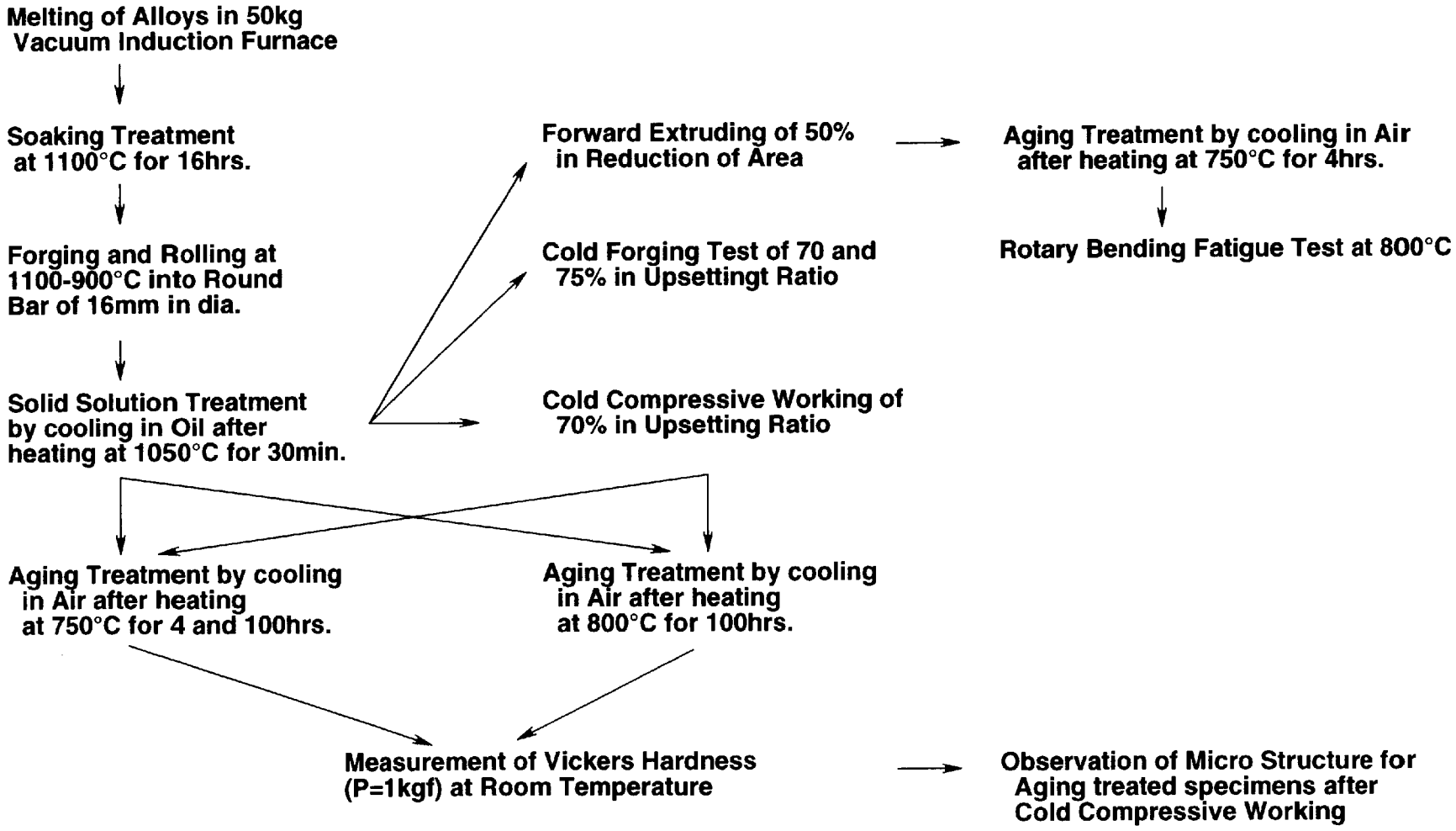
FIG. 2 is a flow diagram showing a process of heat treatment of alloys in Example 2 together with testing methods of the alloy.

Alloys of 50 kg having chemical compositions as shown in Table 3 were melted respectively in a vacuum induction furnace, thereby obtaining ingots, and properties of the respective alloys were examined according to the process as shown in FIG. 2.

TABLE 3

| Alloy No. | | Chemical composition (wt %) C | Si | Mn | P | S | Cu | Ni | Fe | Co | Cr | W | Mo | Nb + Ta | Al | Ti | V | Zr | B | Ca + Mg | O | N | M-value | Ti/Al (at %) | Al + Ti + Nb + Ta (at %) |
|---|---|---|---|---|---|---|---|---|---|---|---|---|---|---|---|---|---|---|---|---|---|---|---|---|---|
| Invention alloy | 20 | 0.012 | 0.21 | 0.20 | — | — | 0.52 | 32.1 | 47.4 | — | 16.4 | — | — | 0.35 | 2.35 | 0.48 | — | — | — | — | — | — | 0.928 | 0.115 | 5.51 |
| | 21 | 0.083 | 0.22 | 0.20 | — | — | 3.99 | 31.8 | 43.6 | — | 16.0 | — | — | 1.86 | 0.78 | 1.44 | — | — | 0.0032 | — | — | — | 0.912 | 1.04 | 4.41 |
| | 22 | 0.048 | 0.19 | 0.22 | — | — | 4.11 | 42.2 | 27.8 | — | 21.2 | — | — | 0.83 | 2.10 | 1.33 | — | — | — | — | — | — | 0.932 | 0.357 | 6.30 |
| | 23 | 0.033 | 0.22 | 0.21 | — | — | 2.07 | 32.2 | 47.1 | — | 13.4 | — | 1.52 | 0.44 | 2.27 | 0.51 | — | — | 0.0027 | — | — | — | 0.921 | 0.127 | 5.49 |
| | 24 | 0.046 | 0.21 | 1.21 | — | — | 2.02 | 31.8 | 47.4 | — | 13.5 | 1.44 | — | 0.51 | 2.25 | 0.58 | — | — | 0.0031 | — | — | — | 0.920 | 0.145 | 5.59 |
| | 25 | 0.050 | 0.22 | 0.20 | — | — | 1.99 | 31.8 | 46.2 | — | 14.4 | 0.98 | 0.56 | 0.56 | 2.11 | 0.88 | — | — | 0.0040 | — | — | — | 0.926 | 0.235 | 5.68 |
| | 26 | 0.031 | 0.18 | 0.17 | — | — | 1.94 | 28.7 | 47.1 | 2.11 | 15.9 | — | — | 0.82 | 2.08 | 0.93 | — | — | 0.0033 | — | — | — | 0.930 | 0.252 | 5.78 |
| | 27 | 0.042 | 0.20 | 0.18 | — | — | 2.06 | 31.9 | 44.7 | — | 16.0 | — | 0.51 | 0.83 | 2.05 | 0.92 | 0.56 | — | 0.0040 | — | — | — | 0.933 | 0.253 | 5.72 |
| | 28 | 0.046 | 0.22 | 0.21 | — | — | 2.04 | 32.0 | 45.3 | — | 16.1 | — | — | 1.03 | 2.01 | 1.01 | — | — | — | — | — | — | 0.929 | 0.283 | 5.86 |
| | 29 | 0.023 | 0.14 | 0.13 | — | — | 1.93 | 31.4 | 46.7 | — | 15.6 | — | — | 1.06 | 1.70 | 1.34 | — | — | — | — | — | — | 0.927 | 0.444 | 5.65 |
| | 30 | 0.051 | 0.19 | 0.20 | — | — | 2.01 | 32.2 | 44.4 | — | 16.0 | — | — | 1.56 | 1.50 | 1.42 | 0.47 | — | 0.0044 | — | — | — | 0.932 | 0.533 | 5.64 |
| | 31 | 0.053 | 0.19 | 0.18 | — | — | 1.98 | 31.7 | 45.4 | — | 16.1 | — | — | 1.50 | 1.44 | 1.45 | — | 0.0035 | — | — | — | — | 0.928 | 0.567 | 5.52 |
| | 32 | 0.049 | 0.21 | 0.20 | — | — | 1.89 | 29.5 | 46.3 | 2.06 | 16.0 | — | — | 1.10 | 1.30 | 1.43 | — | — | — | 0.0030 | — | — | 0.923 | 0.620 | 4.97 |
| | 33 | 0.050 | 0.18 | 0.21 | 0.001 | 0.002 | 1.92 | 31.8 | 45.9 | — | 15.7 | 0.04 | 0.02 | 1.46 | 1.32 | 1.41 | — | — | 0.0037 | 0.0033 | 0.0031 | 0.0033 | 0.923 | 0.602 | 5.21 |
| | 34 | 0.033 | 0.21 | 0.21 | 0.002 | 0.002 | 2.04 | 32.3 | 44.4 | — | 16.3 | — | — | 0.77 | 2.25 | 1.45 | — | — | 0.0040 | 0.0023 | 0.0028 | 0.0025 | 0.94 | 0.363 | 6.6 |
| | 35 | 0.044 | 0.22 | 0.20 | 0.002 | 0.002 | 2.12 | 30.5 | 44.1 | 1.41 | 16.3 | — | — | 1.12 | 2.54 | 1.42 | — | — | — | 0.0030 | 0.0035 | 0.0027 | 0.949 | 0.315 | 7.42 |
| | 36 | 0.051 | 0.23 | 1.20 | 0.001 | 0.001 | 4.08 | 42.3 | 25.7 | — | 20.9 | — | — | 0.83 | 2.25 | 1.40 | — | 0.0041 | 0.0023 | 0.0021 | 0.0026 | 0.0030 | 0.956 | 0.350 | 6.61 |
| | 37 | 0.050 | 0.20 | 0.21 | 0.001 | 0.002 | 2.01 | 32.0 | 45.0 | — | 16.0 | 0.04 | — | 1.49 | 2.01 | 0.99 | — | — | 0.0032 | 0.0013 | 0.0032 | 0.0031 | 0.932 | 0.277 | 6.12 |
| Comparative alloy | 6 | 0.048 | 0.21 | 0.21 | 0.002 | 0.003 | — | 32.2 | 45.2 | — | 15.9 | 0.04 | — | 0.80 | 0.99 | 2.40 | — | — | 0.0048 | 0.003 | — | — | 0.928 | 1.366 | 5.28 |
| | 7 | 0.050 | 0.22 | 0.20 | 0.001 | 0.003 | 0.51 | 32.2 | 36.91 | — | 25.8 | — | — | 0.79 | 1.86 | 1.45 | — | — | 0.0056 | 0.004 | — | — | 0.962 | 0.439 | 5.86 |
| | 8 | 0.083 | 0.21 | 0.20 | 0.001 | 0.002 | — | 31.8 | 46.8 | — | 16.0 | — | — | 1.12 | 0.46 | 1.43 | — | — | 0.0030 | — | — | — | 0.903 | 1.751 | 3.29 |
| | 9 | 0.061 | 0.50 | 1.33 | 0.006 | 0.004 | 3.52 | 13.2 | 59.78 | — | 15.5 | — | 6.1 | — | — | — | — | — | — | — | — | — | 0.915 | — | — |
| | 10 | 0.021 | 0.18 | 0.21 | 0.001 | 0.001 | — | 24.7 | 54.07 | — | 16.3 | — | — | 0.64 | 0.35 | 3.52 | — | — | 0.0022 | — | — | — | 0.947 | 5.665 | 5.16 |

The obtained ingots were subjected to soaking treatment at a temperature of 1100° C. for 16 hours and formed into round bars of 16 mm in diameter through successive forging and rolling at a temperature range of 1100° C. to 900° C. Furthermore, the round bars were heat-treated under a condition of cooling in oil after heating at 1050° C. for 30 minutes (solid solution treatment), and cold forging test was carried out at a room temperature by using the heat-treated round bars at upsetting ratios of 70% and 75% in the same manner as Example 1, the cold workability of the respective alloys was evaluated by examining a state of the crack development by the cold forging test.

The heat-treated round bars were subjected to aging treatment under three conditions of cooling in air after heating at 700° C. for 4 hours and 100 hours, and at 800° C. for 100 hours, respectively, and then Vickers hardness (load :1 kgf) was measured for the respective aging treated round bars.

Furthermore, compressive test (cold working) with upsetting ratio of 70° C. was carried out for the respective heat-treated (solid solution treatment) round bars, and the compressive worked round bars were subjected to the aging treatment under the three conditions as mentioned above.

Then, Vickers hardness of the aging treated round bars was measured in the same manner, and the micro-structure was observed for the respective round bars subjected to the aging treatment after the cold working.

Additionally, the solid solution treated round bars were subjected to forward extruding (reduction of area : 50%) and further subjected to the aging treatment by cooling in air after heating at 750° C. for 4 hours. The rotary bending fatigue test was performed at 800° C. for the respective specimens obtained through the extruding of the round bar and the aging treatment.

Results obtained by the aforementioned evaluation tests are shown in Table 4.

TABLE 4

| | | | Hardness (HV) after solid solution treatment and aging treatment | | | Hardness (HV) after without solid solution treatment aging treatment | | | Precipitation of η-phase after aging treatment without solid solution treatment | | Rotary bending fatigue at 800° C. |
|---|---|---|---|---|---|---|---|---|---|---|---|
| | | Cold | Aging temperature 750° C. | | Aging temperature 800° C. | Aging temperature 750° C. | | Aging temperature 800° C. | Aging temperature | Aging temperature | Number of repetitions |
| Alloy No. | | workability | 4 hr | 100 hr | 100 hr | 4 hr | 100 hr | 100 hr | 750° C. | 800° C. | (× $10^6$ times) |
| Invention alloy | 20 | ○ | 238 | 256 | 288 | 358 | 323 | 252 | No | No | 1.98 |
| | 21 | ○ | 252 | 291 | 227 | 381 | 344 | 269 | No | No | 2.07 |
| | 22 | ○ | 281 | 305 | 252 | 422 | 403 | 338 | No | No | 3.16 |
| | 23 | ○ | 247 | 273 | 209 | 376 | 341 | 278 | No | No | 2.23 |
| | 24 | ○ | 253 | 284 | 216 | 382 | 338 | 291 | No | No | 2.39 |
| | 25 | ○ | 264 | 298 | 259 | 413 | 376 | 308 | No | No | 2.96 |
| | 26 | ○ | 270 | 306 | 244 | 426 | 382 | 313 | No | No | 2.82 |
| | 27 | ○ | 268 | 297 | 231 | 428 | 373 | 307 | No | No | 2.68 |
| | 28 | ○ | 261 | 289 | 238 | 435 | 361 | 292 | No | No | 3.05 |
| | 29 | ○ | 276 | 303 | 265 | 441 | 410 | 348 | No | No | 3.61 |
| | 30 | ○ | 284 | 312 | 279 | 451 | 412 | 353 | No | No | 3.52 |
| | 31 | ○ | 280 | 316 | 280 | 446 | 408 | 355 | No | No | 2.97 |
| | 32 | ○ | 277 | 312 | 249 | 438 | 396 | 337 | No | No | 2.89 |
| | 33 | ○ | 285 | 323 | 268 | 449 | 404 | 343 | No | No | 3.15 |
| | 34 | ○ | 269 | 290 | 242 | 430 | 407 | 338 | No | No | 2.78 |
| | 35 | ○ | 276 | 308 | 256 | 439 | 390 | 327 | No | No | 2.94 |
| | 36 | ○ | 289 | 324 | 273 | 442 | 422 | 356 | No | No | 3.47 |
| | 37 | ○ | 267 | 287 | 235 | 444 | 378 | 310 | No | No | 3.16 |
| Comparative alloy | 6 | X | 312 | 373 | 332 | 462 | 396 | 324 | No | Precipitation | 2.53 |
| | 7 | X | 298 | 335 | 341 | 447 | 425 | 389 | No | Precipitation of γ-phase | 1.27 |
| | 8 | X | 249 | 287 | 223 | 368 | 312 | 241 | Precipitation | Precipitation | 1.86 |
| | 9 | X | 231 | 224 | 189 | 325 | 307 | 219 | Precipitation of $Fe_2Mo$ | Precipitation of $Fe_2Mo$ | 0.74 |
| | 10 | X | 283 | 374 | 291 | 423 | 344 | 276 | Precipitation | Precipitation | 2.11 |

The respective tests were performed under the following conditions.

(Measurement of hardness)

The hardness of the alloys was measured using the Vickers hardness tester by measuring load of 1 kgf.

(Fatigue test)

An uniform guage test piecies of 8 mm in diameter were cut out from the respective testing materials after the forward extruding, and the rotary bending fatigue test was carried out at 800° C. using the Ono-type rotary bending fatigue testing machine. The number of repetitions when stress amplitude was 294 MPa was obtained with the average value of two measurements.

From the results shown in Table 4, it was confirmed that the cold workability was excellent, the sufficient hardness was obtained by the aging treatment after the cold working, the η-phase was not precipitated even when the aging treatment was performed directly after the cold wording and the averaging could be prevented, and the hardess was not so degraded even by the application at a high temperature for a long time, namely the overaging could be inhibited in the heat resisting alloys belonging to inventive alloys of this example.

Furthermore, it was apparent from the results of the fatigue test that the inventive alloys of this example were equal or excellent also in the fatigue properties.

Example 3

Alloys of 50 kg having chemical compositions as shown in Table 5 were melted in a vacuum induction furnace and cast into ingots, respectively.

TABLE 5

| Alloy No. | Chemical composition (wt %) C | Si | Mn | Cu | Ni | Co | Cr | W | Mo | Nb + Ta | Al | Ti | B | Mg + Ca | Fe | Ti/Al (at %) | M-value | Al + Ti + Nb + Ta (at %) |
|---|---|---|---|---|---|---|---|---|---|---|---|---|---|---|---|---|---|---|
| 1 | 0.051 | 0.21 | 0.20 | 0.98 | 32.1 | — | 16.4 | — | — | 0.82 | 1.15 | 2.29 | 0.0030 | — | 45.8 | 1.48 | 0.934 | 5.34 |
| 2 | 0.083 | 0.22 | 0.20 | 4.05 | 31.8 | — | 16.0 | — | — | 0.78 | 1.64 | 1.76 | 0.0032 | 0.003 | 43.5 | 0.60 | 0.928 | 5.71 |
| 3 | 0.048 | 0.19 | 0.22 | 2.20 | 31.9 | — | 16.3 | — | — | 0.88 | 1.98 | 1.49 | 0.0050 | — | 45.0 | 0.42 | 0.936 | 6.11 |
| 4 | 0.033 | 0.22 | 0.21 | 2.07 | 32.2 | — | 14.1 | 0.99 | 0.56 | 1.52 | 2.27 | 0.51 | 0.0027 | — | 45.3 | 0.13 | 0.914 | 5.91 |
| 5 | 0.046 | 0.21 | 0.21 | 1.04 | 42.2 | — | 16.3 | — | — | 0.81 | 0.85 | 2.8 | 0.0031 | — | 35.5 | 1.86 | 0.923 | 5.53 |
| 6 | 0.050 | 0.22 | 0.20 | 1.99 | 31.8 | — | 15.9 | — | — | 0.83 | 2.36 | 0.84 | 0.0040 | — | 45.8 | 0.20 | 0.932 | 6.10 |
| 7 | 0.031 | 0.18 | 0.19 | 1.94 | 25.8 | 1.1 | 15.9 | — | — | 0.62 | 0.55 | 3.41 | 0.0033 | — | 50.3 | 3.49 | 0.914 | 5.34 |

These ingots of 7 kinds were forged into 70 mm in diameter after soaking treatment and rolled into round bars of 16 mm in diameter. Successively, the round bars were subjected to solid solution treatment by cooling into oil after holding at 1050° C. for 30 minutes in order to use them as raw materials for head portions of exhaust valves.

The exhaust valves were produced by using these materials through the following three methods according to this invention and the comparative conventional method.

(1) Method 1

The respective raw materials were formed into head portions having diameters of 24.3 mm through cold working at a room temperature, and then stem portions having diameters of 5.8 mm made of JIS SUH-11 were joined to the respective head portions by friction welding.

Subsequently, the head and stem portions joined with each other were subjected to aging treatment by cooling in air after holding at 750° C. for 4 hours and finished, and 7 kinds of exhaust valves were produced by further performing tufftride treatment at 570° C. for 30 minutes. These exhaust valves are to be used for valve gear system of direct type.

(2) Method 2

Seven kinds of exhaust valves were produced in the same manner as Method 1 excepting that the respective raw materials were formed into head portions through worm working at 500° C. instead of the cold working. These exhaust valves are also to be used for the valve gear system of direct type.

(3) Method 3

High-frequency heating was applied to the tail ends of the stem portions of the exhaust valves produced in accordance with method 1, the valves were cooled in air after heating at 1050° C. for 30 seconds. These exhaust valves are to be used for valve gear system of rocker arm type.

(4) Conventional method

The respective raw materials were formed into head portions having diameters of 24.3 mm through hot upsetting after preforming by electric upsetting method, and then stem portions (5.8 mm in diameter) made of JIS SUH-11 were joined to the respective head portions by friction welding.

Subsequently, the joined head and stem portions were subjected to solid solution treatment by cooling in oil after holding at 1050° C. for 30 minutes, and successively subjected to aging treatment by cooling in air after holding at 750° C. for 4 hours.

After this, finishing was carried out and the tufftride treatment was further performed at 570° C. for 30 minutes, and the exhaust valves to be used the valve gear system of rocker arm type were produced by cooling the tail ends of the stem portion in air after heating at 1050° C. for 30 seconds with high frequency.

The hardness at valve faces of the respective exhaust valves produced through the aforementioned methods was measured. Furthermore, production costs of the valves manufactured according to the production methods 1, 2 and 3 were compared with those of the valves manufactured through the conventional method. These results are shown in Table 6.

TABLE 6

| Alloy No. | Method 1 Hardness at Valve face (HV) | Method 1 Production cost | Method 2 Hardness at Valve face (HV) | Method 2 Production cost | Method 3 Hardness at Valve face (HV) | Method 3 Production cost | Conventional method Hardness at Valve face (HV) |
|---|---|---|---|---|---|---|---|
| 1 | 475 | inexpensive rather than conventional method | 472 | inexpensive rather than conventional method | 474 | inexpensive rather than conventional method | 313 |
| 2 | 452 | inexpensive rather than conventional method | 454 | inexpensive rather than conventional method | 456 | inexpensive rather than conventional method | 293 |
| 3 | 434 | inexpensive rather than conventional method | 430 | inexpensive rather than conventional method | 431 | inexpensive rather than conventional method | 288 |
| 4 | 420 | inexpensive rather than conventional method | 417 | inexpensive rather than conventional method | 418 | inexpensive rather than conventional method | 281 |
| 5 | 497 | inexpensive rather than conventional method | 489 | inexpensive rather than conventional method | 495 | inexpensive rather than conventional method | 353 |
| 6 | 410 | inexpensive rather than conventional method | 412 | inexpensive rathet than conventional method | 407 | inexpensive rather than conventional method | 387 |

TABLE 6-continued

| | Method 1 | | Method 2 | | Method 3 | | Conventional method |
|---|---|---|---|---|---|---|---|
| Alloy No. | Hardness at Valve face (HV) | Production cost | Hardness at Valve face (HV) | Production cost | Hardness at Valve face (HV) | Production cost | Hardness at Valve face (HV) |
| 7 | 470 | inexpensive rather than conventional method | 462 | inexpensive rather than conventional method | 472 | inexpensive rather than conventional method | 320 |

It was confirmed that the valve faces of the exhaust valves produced through the methods 1 to 3 according to this invention was hardened as compared with the valve faces of the exhaust valves produced through the conventional method.

Therefore, the exhaust valves of the valve gear system of direct type produced from the alloys No.1 to No.3 through method 1 and the conventional method were assembled into a practical engine, and an endurance test carried out at 800° C. and 6000 rpm for 100 hours. After the endurance test, the extent of damage at the head and neck portions of the exhaust valves was observed.

As results of the observation, the damage was not recognized in any cases. The exhaust valves taken apart from the engine and the hardness at the valve faces was measured. Consequently, it became clear that Vickers hardness at the valve faces of the exhaust valves was in a range of 280 to 350 in all eases and there is no difference between the conventional method and the method 1 according to this invention.

As mentioned above, the heat resisting alloy according to this invention is low in Ni content and inexpensive in the cost, and excellent in the cold workability, furthermore it is possible to produce heat resisting parts or members, such a the exhaust valves for the automotive engine through the cold wording and possible to reduce the production cost of the heat resisting parts or members. Namely, it is possible to reduce bothe the material cost of the heat resisting alloy and the production cost of the heat resisting parts or members by using the heat resisting alloy according to this invention.

The heat resisting alloy according to this invention has a special feature in that Cu is contained in a certain range, and Cu works to inhibit the work hardening by increasing stacking faust energy, thereby improving the cold workability of the heat resisting alloy effectively.

The exhaust valve manufactured through the method according to another aspect of this invention shows properties same as the exhaust valve manufactured through the conventional method.

Additionally, it is possible to reduce the forming cost of the head portion of the exhaust valve as compared with the conventional method because the head portion is formed by cold or warm working in the method according to this invention, furthermore the dimensional accuracy of the head portion is improved and the cutting amount in the finishing process becomes smaller, therefore it is possible to reduce the whole production cost of the exhaust valve. Namely, in the method according to this invention, it is possible to inexpensively produce the exhaust valve comparable favorably with the conventional exhaust valve in their properties.

What is claimed is:

1. A heat resisting alloy for exhaust valves consisting by weight percentage of 0.01 to 0.1% of C, not more than 2% of Si, not more than 2% of Mn, 12 to 21.2% of Cr, 0.2 to 2.0% in total of Nb and Ta, not more than 3.5% of Ti, 0.5 to 3.0% of Al, 25 to 45% of Ni, 0.52 to 5.0% of Cu, and the balance being Fe plus incidental impurities.

2. A heat resisting alloy for exhaust valves consisting by weight percentage of 0.01 to 0.1% of C, not more than 2% of Si, not more than 2% of Mn, 12 to 21.2% of Cr, 0.2 to 2.0% in total of Nb and Ta, not more than 3.5% of Ti, 0.5 to 3.0% of Al, 25 to 45% of Ni, 0.52 to 5.0% of Cu, at least one element selected from not more than 3% of W, not more than 3% of Mo and not more than 1% of V with the proviso that (½W+Mo+V) is at most equal to 3%, and the balance being Fe plus incidental impurities.

3. A heat resisting alloy for exhaust valves consisting by weight percentage of 0.01 to 0.1% of C, not more than 2% of Si, not more than 2% of Mn, 12 to 21.2% of Cr, 0.2 to 2.0% in total of Nb and Ta, not more than 3.5% of Ti, 0.5 to 3.0% of Al, 25 to 45% of Ni, 0.52 to 5.0% of Cu, not more than 2.11% of Co with the proviso that total percentage of Ni and Co is in a range of 25 to 45%, and the balance being Fe plus incidental impurities.

4. A heat resisting alloy for exhaust valves according to claim 1, wherein total atomic percentage of Ti, Al, Nb and Ta is in a range of 4.5 to 7.0%.

5. A heat resisting alloy for exhaust valves according to claim 1, wherein an atomic percentage ratio Ti/Al is not higher than 2.0.

6. A heat resisting alloy for exhaust valves according to claim 1, wherein M-value calculated using the following equation does not exceed 0.95;

$$M=\{0.717Ni(\text{atomic percentage})+0.858Fe(\text{atomic percentage})+1.142Cr(\text{atomic percentage})+1.90Al(\text{atomic percentage})+2.271Ti(\text{atomic percentage})+2.117Nb(\text{atomic percentage})+2.224Ta(\text{atomic percentage})+1.001Mn(\text{atomic percentage})+0.615Cu(\text{atomic percentage})\}/100.$$

7. A heat resisting alloy for exhaust valves consisting by weight percentage of 0.01 to 0.1% of C, not more than 2% of Si, not more than 2% of Mn, 12 to 21.2% of Cr, 0.2 to 2.0% in total of Nb and Ta, not more than 3.5% of Ti, 0.5 to 3.0% of Al, 25 to 45% of Ni, 0.52 to 5.0% of Cu, 0.001 to 0.01% of Ca and Mg in total, and the balance being Fe plus incidental impurities.

8. A heat resisting alloy for exhaust valves according to claim 1, wherein said impurities are controlled so that P is not higher than 0.02%, S, O and N are not higher than 0.01%, respectively.

9. A heat resisting alloy for exhaust valves consisting by weight percentage of 0.01 to 0.1% of C, not more than 2% of Si, not more than 2% of Mn, 12 to 21.2% of Cr, 0.2 to 2.0% in total of Nb and Ta, not more than 3.5% of Ti, 0.5 to 3.0% of Al, 25 to 45% of Ni, 0.52 to 5.0% of Cu, one or both of 0.001 to 0.01% of B and 0.001 to 0.1% of Zr, and the balance being Fe plus incidental impurities.

* * * * *